US006563475B2

(12) United States Patent
Ianello et al.

(10) Patent No.: US 6,563,475 B2
(45) Date of Patent: May 13, 2003

(54) ANTENNA MOUNT

(75) Inventors: Daniel J Ianello, Mishawaka, IN (US); Thomas N Strantz, Osceola, IN (US)

(73) Assignee: PiRod, Inc., Plymouth, IN (US)

( * ) Notice: Subject to any disclaimer, the term of this patent is extended or adjusted under 35 U.S.C. 154(b) by 0 days.

(21) Appl. No.: 09/977,709

(22) Filed: Oct. 15, 2001

(65) Prior Publication Data

US 2002/0053996 A1 May 9, 2002

Related U.S. Application Data

(60) Provisional application No. 60/240,236, filed on Oct. 13, 2000.

(51) Int. Cl.[7] ..... H01Q 1/12

(52) U.S. Cl. ..... 343/890; 52/726.1; 248/219.4; 248/230.1

(58) Field of Search ..... 343/878, 890, 343/891, 892; 52/726.1, 726.3, 736.2; 248/219.4, 230.1, 230.6, 534, 539

(56) References Cited

U.S. PATENT DOCUMENTS

| | | | |
|---|---|---|---|
| 4,197,548 | A | 4/1980 | Smith et al. |
| 4,626,864 | A | 12/1986 | Micklethwaite |
| 4,755,830 | A | 7/1988 | Plunk |
| 5,533,304 | A | 7/1996 | Noble |
| 5,787,673 | A | 8/1998 | Noble |
| 5,867,132 | A | 2/1999 | Blasing et al. |
| 5,954,305 | A | 9/1999 | Calabro |
| 6,018,325 | A | 1/2000 | Lundgren |
| 6,043,795 | A | 3/2000 | Strieffler et al. |

*Primary Examiner*—Tho Gia Phan
(74) *Attorney, Agent, or Firm*—Baker & Daniels

(57) ABSTRACT

A mounting assembly for affixing an antenna platform or mounting arm to a pole. The mounting assembly includes a plurality of clamps for positioning about the circumference of the pole. The preferred embodiment uses three clamps and each of the clamps has a pole mounting surface contoured to mount securely to a variety of pole circumferences. The mounting assembly also includes a plurality of interconnection members extending between the clamps for securing the clamps to the pole. In the embodiment shown, each of the clamps includes a pair of identical spaced apart side plates. The side plates include connecting extensions for attachment of the interconnection members. The clamps include reinforcing plates attached to the connecting extensions, and the reinforcing plates having apertures for receiving the interconnection members. The mounting assembly also includes a middle support plate attached to and interconnecting each pair of side plates. The middle support plate is configured for receipt and attachment of the platform to be supported. The clamps also include a flange plate attached to and extending between each pair of side plates and also attached to the middle support plate for providing structural stability to the clamp. A shim plate is provided for closing any gaps between the clamps and the pole.

22 Claims, 7 Drawing Sheets

ANTENNA MOUNT

BACKGROUND OF THE INVENTION

The present invention relates to a mounting assembly for affixing antenna platforms and antenna mounting arms to poles, and more particularly, to a mounting assembly that is adaptable to provide a tight fit on poles over a wide range of diameters.

Antenna poles or towers have long been in use for the transmission, reception and forwarding of radio and television signals. In addition, microwave antennas have come into frequent demand and usage for cellular communications. Such poles generally range in height from 80 to 220 feet and more. Based on the variety of heights and load carrying capacities of these poles, pole diameters may vary greatly. Typically, these types of antenna poles range from approximately 1 to 5 foot in diameter. Furthermore, the poles may have a uniform diameter or be tapered from a thicker diameter at the bottom to a thinner one at the top.

In order to mount antenna platforms or antenna mounting arms on poles, a variety of clamps have been developed. One such clamp is illustrated in U.S. Pat. No. 6,018,325 to Lundgren, herein incorporated by reference. The clamp in Lundgren is of a common clam shell variety having two substantially semi-circular clamp members which are placed about the pole and bolted together. Lundgren also discloses a clamp having a faceted clamping surface for matching up against a faceted pole. A drawback with the clamps disclosed in Lundgren is that the clamps must be individually sized to the diameter of the pole thereby greatly increasing manufacturing costs and the number of clamps which must be stocked. As such, it would be desirable to provide a pole clamp having the flexibility to be used over the complete range of pole diameters.

There are some clamping assemblies that provide some adjustability for clamping to poles of different sizes. For example, in U.S. Pat. No. 5,867,132 to Blasing, et al, herein incorporated by reference, an adjustable clamp is disclosed which can accommodate a pole with a diameter of 1.75" to 4.5". Although this clamp does provide some adjustability, it is still basically a clam shell design, and could not serve as a basis for a single clamp sized to accommodate the range of antenna pole diameters set forth above.

Another antenna support bracket is disclosed in U.S. Pat. No. 6,043,795 to Strieffler et al, herein incorporated by reference. Although this bracket also provides some capability for use on poles of various diameters, the configuration of the clamp and support lug could not be universally used over the complete range of antenna pole diameters. For instance, if the bent clamp in Strieffeler was made large enough to accommodate very large diameter poles, then the clamp ends would need to be spaced further apart than the largest diameter on which it is to be used. This wide spacing would then make the clamp incapable of providing sufficient clamping force on small diameter poles. Furthermore, if the lug and clamp were made large enough to fit the largest diameter poles, it would provide large, awkward and unsightly protrusions from a smaller diameter pole. As such, it is a object of the present invention to provide a clamping assembly that can be used over the complete range of antenna poles and will not provide excess protrusions when used on smaller diameter poles.

Another form of adjustable pole clamp is disclosed in U.S. Pat. No. 4,755,830 to Plunk, herein incorporated by reference. The problem with this clamp is that the adjustable set screws do not provide sufficient clamping surface to provide a secure fit for large platforms. Also, if the clamping ring was large, the length of the set screws would be excessive on small diameter poles compounding the instability of this clamp. In addition, this design would also provide excessive protrusion when used on smaller poles if the clamping ring were made large enough for larger diameter poles.

In summary, it is an object of the present invention to overcome the shortcomings of the prior art by providing a clamping assembly which would be useable over a wide range of diameter poles and provide a secure mount without creating excessive protrusions when used on smaller diameter poles.

SUMMARY OF THE INVENTION

It is a feature of the invention to provide a mounting assembly for affixing an antenna platform or mounting arm to a pole. The mounting assembly includes a plurality of clamps for postioning about the circumference of the pole, and each of the clamps has a pole mounting surface contoured to mount securely to a variety of pole circumferences. Three clamps are utilized in the preferred embodiment. The mounting assembly also includes a plurality of interconnection members extending between the mounting clamps for securing the mounting clamps to the pole.

Another feature of the invention is that each of the clamps includes a pair of axially offset side plates.

It is also a feature of the invention that the side plates in each pair are parallel to one another.

A further feature of the invention is that the side plates are identical.

Also, a feature of the invention is that the side plates include connecting extensions for attachment of the interconnection members.

Another feature of the invention is that the mounting assembly includes reinforcing plates attached to the connecting extensions and that the reinforcing plates having apertures for receiving the interconnection members.

The mounting assembly also includes a middle support plate attached to and interconnecting each pair of side plates. The middle support plate is configured for receipt and attachment of the platform to be supported.

An additional feature of the invention is that the mounting assembly has a flange attached to and extending between each pair of side plates. The flange is also attached to the middle support plate for providing structural stability to the clamps.

Another feature of the invention is that the mounting assembly may include a shim plate adjustably connected to at least one of the clamps for tightening the fit of the clamps to the pole.

A further aspect of the invention is that the interconnection members include rods having threaded ends and nuts threadable onto the threaded ends for adjustably tightening the clamps about the pole.

Another feature of the mounting assembly is that the size of the clamps remains constant as the pole diameter is varied, but the length of the interconnection members is increased as the pole diameter is increased.

DESCRIPTION OF THE PREFERRED EMBODIMENT

Figure 1:
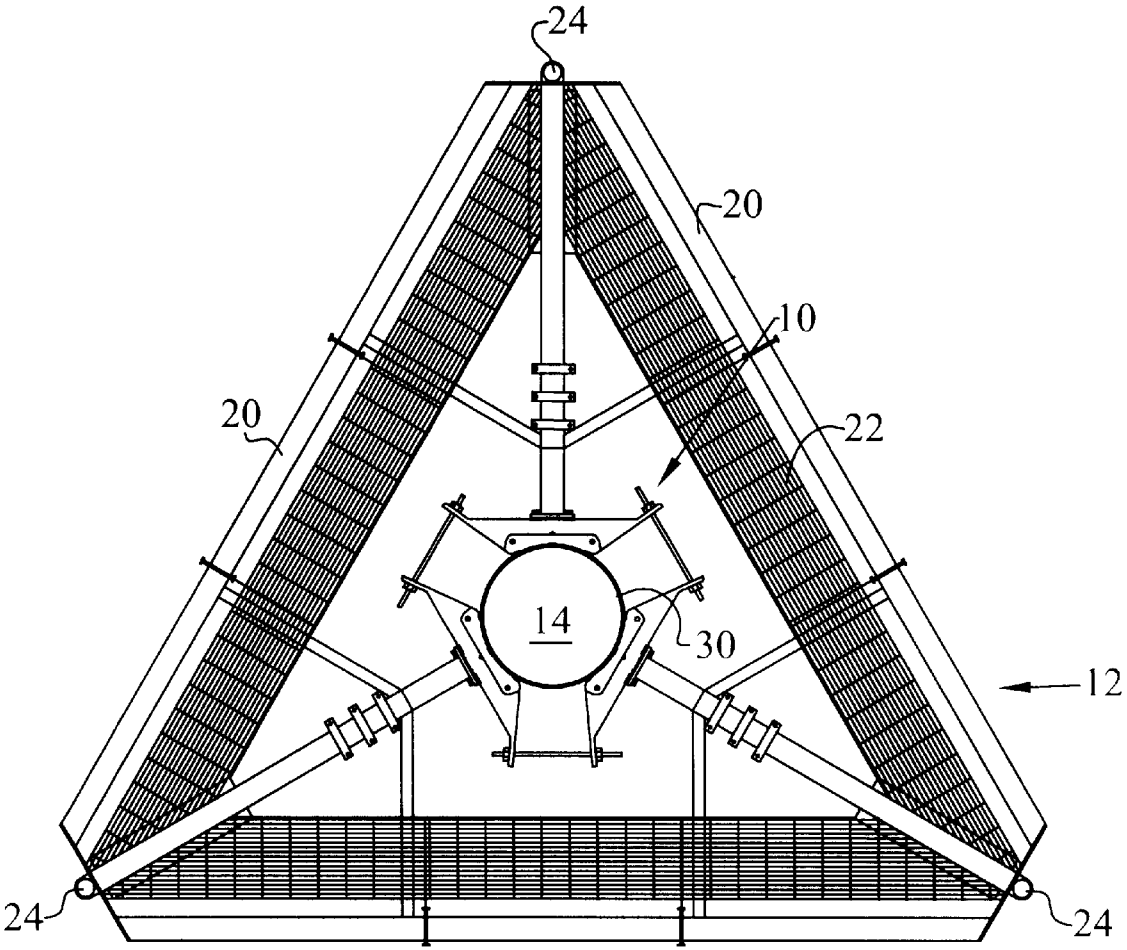
FIG. 1 is a top view of the mounting assembly of the present invention showing the assembly mounted to a pole with an antenna platform affixed to the mounting assembly.
Figure 2:
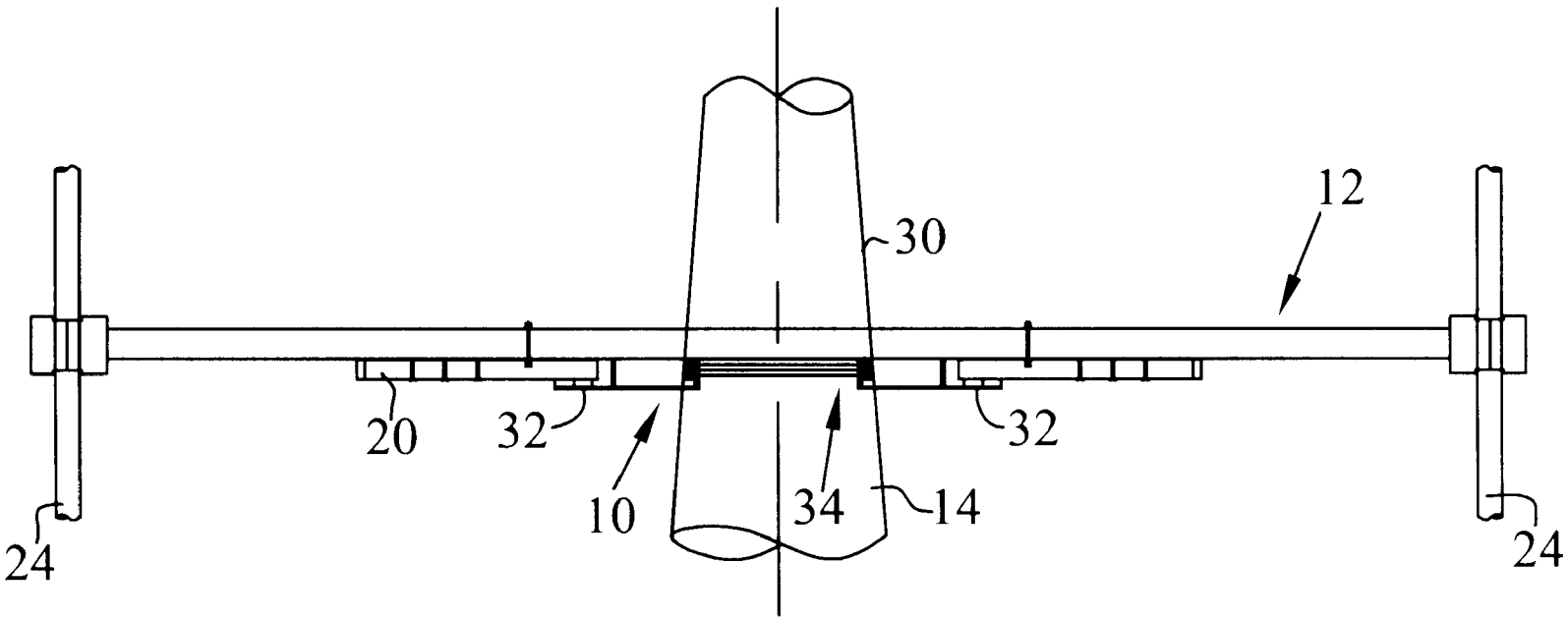
FIG. 2 is a side view of the mounting assembly, pole, and antenna platform of FIG. 1.
Figure 3:
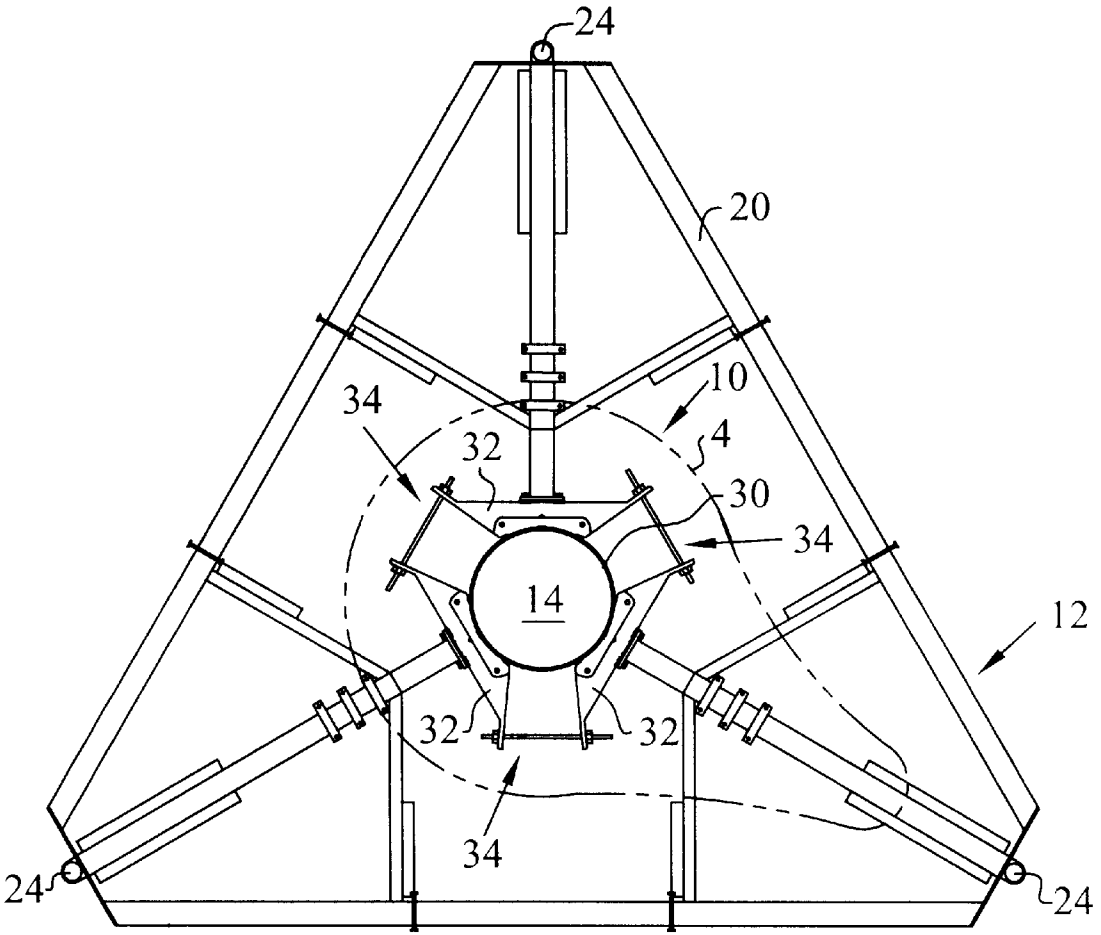
FIG. 3 is a closer top view of the mounting assembly of FIG. 1 shown with the grating removed from the antenna platform.

Referring now to FIGS. 1–3, a mounting assembly generally indicated as 10 is shown for mounting an antenna platform generally indicated as 12 to a pole 14. The antenna platform includes an antenna pipe frame 20, grating 22, and corner antenna pipes 24. The pole 14 may be either tapered or of uniform diameter and includes a circumferential face 30.

Figure 4:
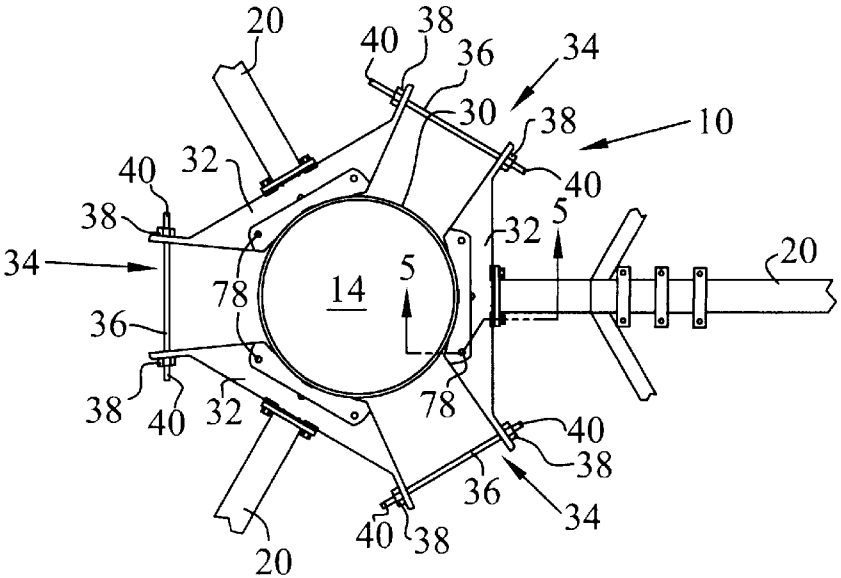
FIG. 4 is a top view of encircled region 4 from FIG. 3.
Figure 6:
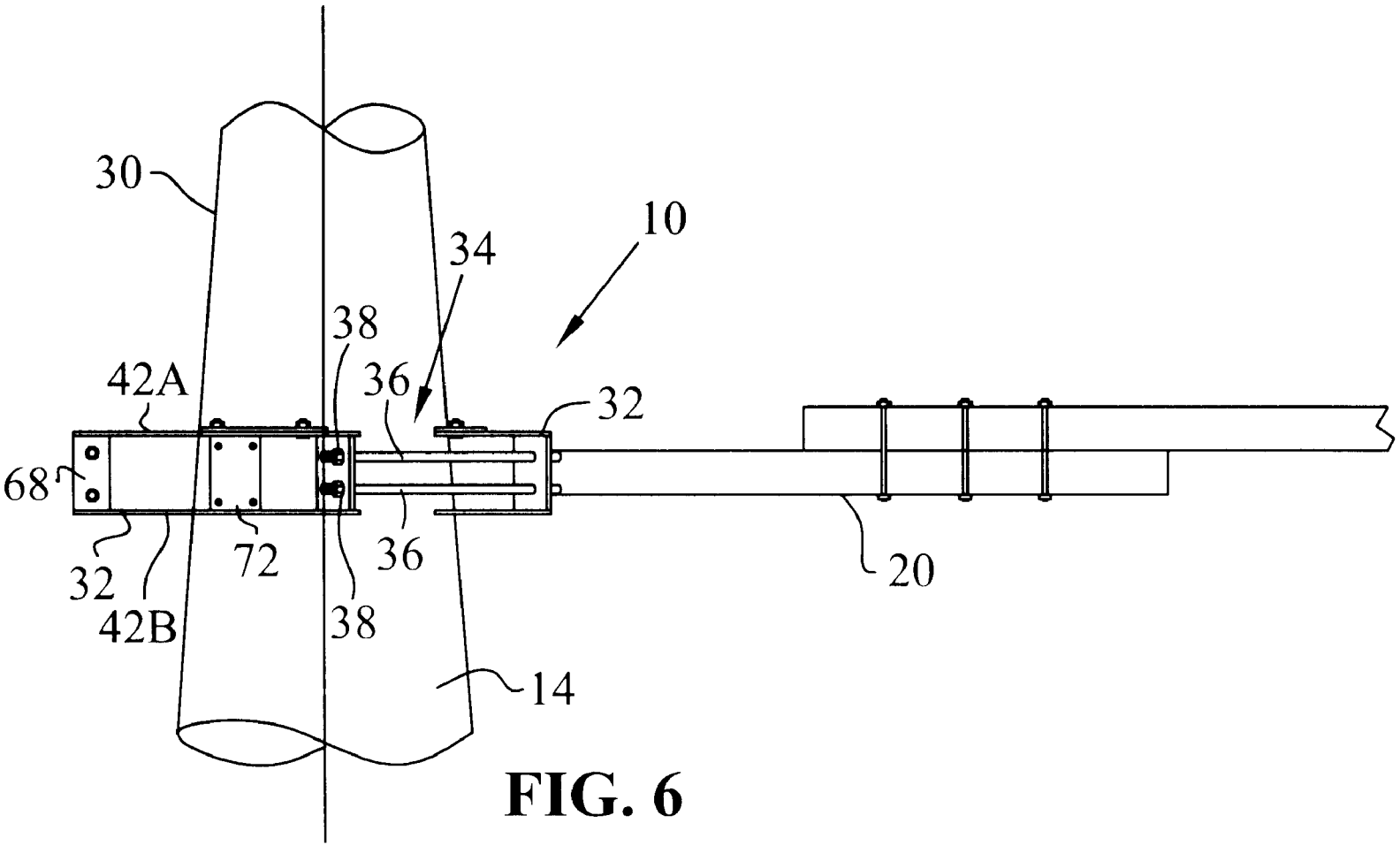
FIG. 6 is a side view of the mounting assembly corresponding with FIG. 4.

The mounting assembly 10 has a plurality of clamps 32 and interconnection assemblies/members generally indicated as 34. As best seen in FIGS. 4 and 6, interconnection members 34 include interconnection rods 36 and interconnection nuts 38. Interconnection rods 36 have threaded ends 40 for receipt of the interconnection nuts.

Figure 7:
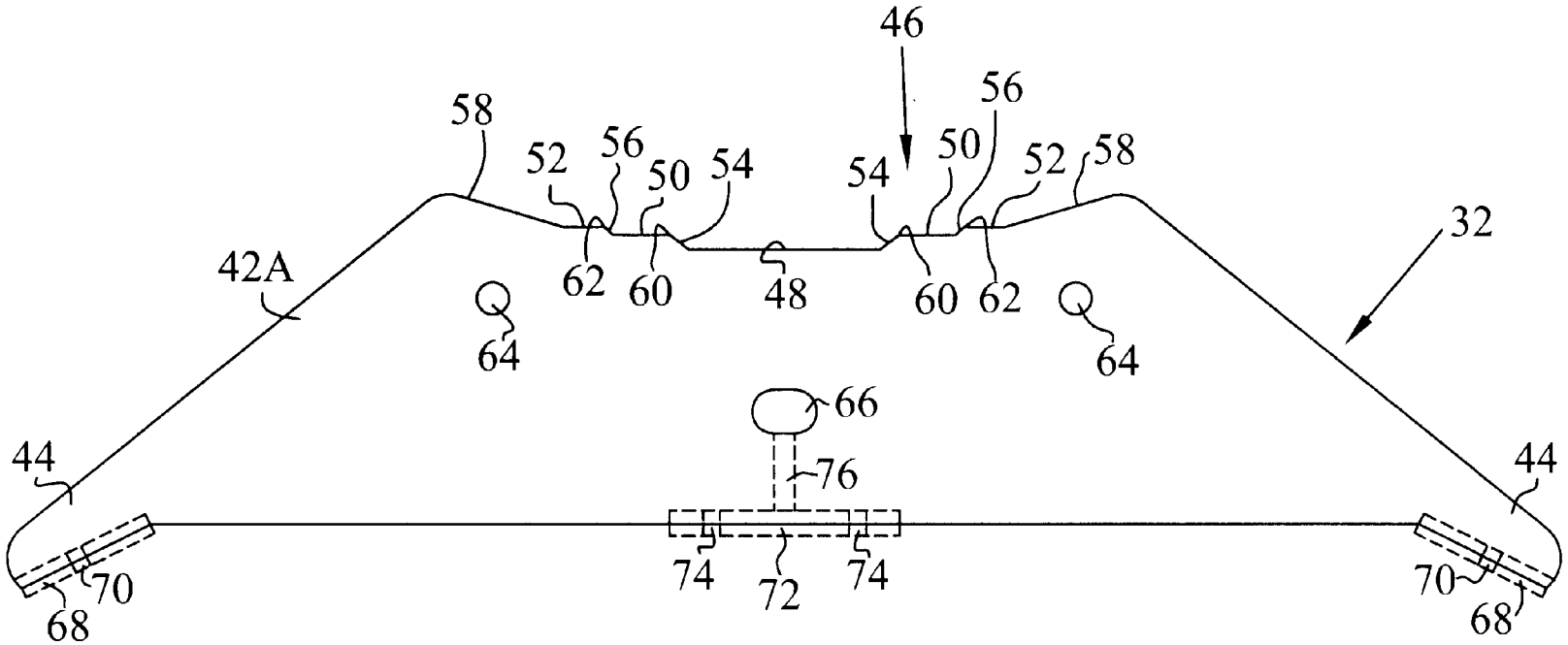
FIG. 7 is a close-up of a clamp of the present invention as would be viewed from the top of the pole.
Figure 8:
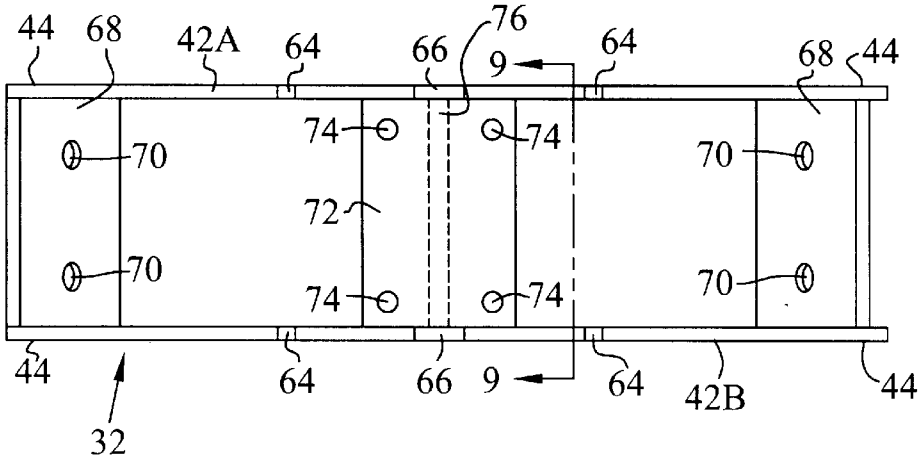
FIG. 8 is a side view of the clamp of the present invention.
Figure 9:
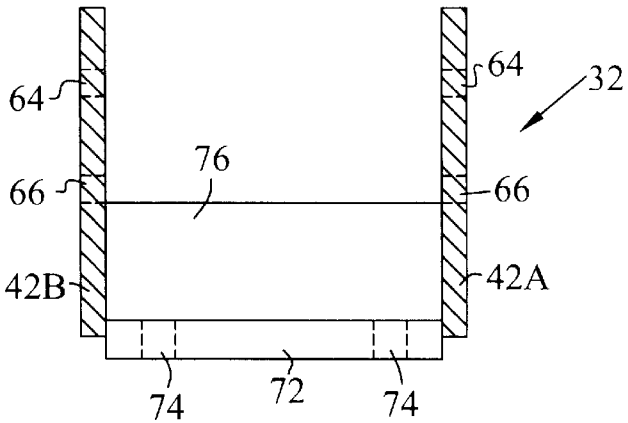
FIG. 9 is a cross section taken along line 9—9 of FIG. 8.

Now referring to FIGS. 7–9, it can be seen that the preferred embodiment of clamps 32 includes a pair of identical and parallel extending side plates consisting of an upper side plate 42*a* and lower side plate 42*b*. Each side plate has a wing or connecting extension 44. At an end opposite wing extensions 44, side plates 42*a*, 42*b* have a contoured clamping surface generally indicated as 46, which includes flat areas 48, 50, and 52 and tapered regions 54, 56 and 58. As can be seen in FIG. 7, flat areas 50 and tapered regions 54 meet to form clamping teeth 60 and flat regions 52 and tapered regions 56 meet to form clamping teeth 62. Side plates 42*a* and 42*b* each include a pair of bolt mounting apertures 64 and a central elongated aperture 66.

Attached to and extending between wing extensions 44 and the side plates 42*a*, 42*b* are reinforcing/interconnection plates 68 with each reinforcing plate having a pair of apertures 70. Likewise, the central portion of side plates 42*a*, 42*b* are joined by a middle support plate 72 having four apertures 74 for connecting clamps 32 to antenna pipe frame 20. Providing additional support to clamp 32 is a central flange 76 attached to middle support plate 72 and side plates 42*a*, 42*b*.

Figure 5:
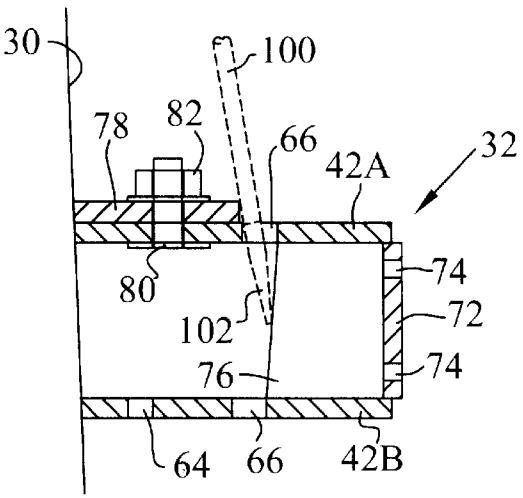
FIG. 5 is a cross-sectional view taken along broken line 5—5 of FIG. 4.

As shown in FIGS. 4 and 5, clamps 32 may also include an adjustable shim plate 78 mounted to side plate 42*a* and/or side plate 42*b* with bolts 80 and nuts 82.

Having outlined the major components of mounting assembly 10, the assembly and operation will be addressed in further detail. Regarding the antenna platform 12, the assembly and parts are well known in the industry and need not be discussed in detail.

In the preferred embodiment, three clamps 32 are utilized and spaced evenly about pole 14. The clamps are placed with the contoured surfaces 46 abutted against circumferential face 30 of the pole and wing extensions 44 away from the pole as shown in FIG. 4. The clamps 32 are interconnected by and tightened down upon the pole with three interconnection assemblies 34. Each interconnection assembly 34 utilizes two interconnection rods 36 spaced slightly vertically apart from one another along the length of the pole. One end of the upper connection rod 36 is inserted through upper aperture 70 in reinforcing plate 66 and the other end of the upper interconnection rod 36 is inserted through the upper aperture 70 in the reinforcing plate 68 in the adjacent clamp 32 as is best shown in FIG. 6. Likewise, the lower connection rod 36 is inserted in the lower apertures 70 of reinforcing plates 68 in adjacent clamps 32. The rods are secured in the apertures by threading nuts 38 on each of the threaded ends 40 of the interconnection rods 36. Similarly, the interconnection rods 36 of the other two interconnection assemblies 34 are used to interconnect the third clamp 32 to the opposite ends of the first and second clamps 32.

It should be noted that the nuts are not tightened down until all of the clamps and interconnection rods are in place. It has been found that if bolts 38 on the upper connection rods 36 are all tightened first so that the contoured clamping surface 46 of upper plate 42*a* is held firmly against circumferential face 30 of pole 14 followed by tightening of the bolts 38 on the lower interconnection rods 36, a firm grip is maintained between mounting assembly 10 and pole 14. This procedure normally provides an acceptable grip even when the pole 14 has a tapered diameter.

However, if the taper of the pole is too great or an otherwise unacceptable gap exists between one of the side plates 42*a*, 42*b* and the pole face 30, adjustable shim plates 78 may be mounted to either side plate 42*a* or 42*b* with bolts 80, which fit loosely in mounting apertures 64. Accordingly, a gap may be closed and a secure fit obtained by using a pry bar 100. As shown in FIG. 5, the point 102 of the pry bar is inserted through elongated aperture 66 and pressed against central flange 76 thereby pushing the shim plate 78 firmly against the pole face 30, whereupon nuts 82 can be tightened on bolts 80 to maintain the tight fit.

As previously noted, the mounting assembly 10 and contoured clamping surface 46 of clamps 32 may be utilized with a wide range of pole diameters. For smaller diameter poles, clamping teeth 60 will be forced into the pole face 30 when nuts 38 are tightened onto rods 36, thereby forming a secure fit. Likewise, larger diameter poles will encounter clamping teeth 62 and the mounting assembly will be held firmly thereby. It should be noted that adjustable shim plates 78 have one edge which is contoured similar to clamping surface 46, the contoured edge being oriented so as to engage the pole face 30.

Although the same clamps 32 may be utilized with a wide range of pole diameters, it may be desirable to vary the length of interconnection rods 36 based upon the diameter of the particular pole for which the mounting assembly is to be affixed. If not, interconnection rods that are long enough to be used on the largest diameter poles would significantly from the assembly when used on small diameter poles. For example, it has been determined that for a 12" diameter pole interconnection rods 36 having a 7¾" length will suffice. On the other hand, if the pole where the mounting assembly 10 is to be affixed has a 48" diameter, the interconnection rods 36 should be at least 39⁹⁄₁₆" inch in length.

Once the mounting assembly 10 is firmly secured to the pole 14 the antenna platform 12 can be attached. In the preferred embodiment, a separate pipe from the antenna pipe frame is connected to each of the middle support plates 72 of clamps 32. The antenna pipes are preferably bolted to middle support plate using bolts (not shown in detail) extending through aperture 74 and securing nuts (not shown in detail). Of course, as will be recognized by one skilled in the art, mounting assembly 10 may also be used to attach one or more antenna mounting arms (not shown) to the middle support plates in lieu of using an antenna platform 12.

It should also be noted that although in the preferred embodiment clamps 32 consist of the configuration described above, numerous variations could be made to the clamp without departing from the spirit and scope of the invention. For instance, a singular piece solid clamp may be used or the contoured clamping surface 46 may be altered suitable to any surface that would satisfactorily grip poles of various diameters. Also, although in the preferred embodiment three clamps and six interconnection rods are used, it is possible to use more or less clamps. In addition, more or less than two rods may be used between each pair of adjacent clamps. Interconnection rods 36 may also be threaded along the entire length and then cut to the proper length to coincide with the diameter of the pole for which the assembly is to be mounted. This eliminates the need to stock multiple lengths of rod or to cut and thread smooth rods. Furthermore, any interconnection member may be substituted for interconnection rods 36 and nuts 38 as long as said interconnection members provide adjustable tightening of the clamps against a variety of pole diameters.

Someone skilled in the art will also recognize other changes that can be made in form and detail without departing from the spirit and scope of the invention. Described embodiments are to be considered in all respects as illustrative and not restrictive. The scope of the invention is therefore, indicated by the following claims rather than by the description.

What is claimed is:

1. A mounting assembly for affixing an antenna platform or mounting arm to a pole having an upper end, said mounting assembly comprising a plurality of at least three clamps for positioning around the circumference of the pole below the upper end thereof, each of said clamps configured to have a pole mounting surface that is contoured to mount securely on the circumference of the pole and further configured to mount to a variety of pole circumferences, and a plurality of interconnection members extending between said clamps for securing the clamps to the poles.

2. The mounting assembly as set forth in claim 1, wherein each of said clamps includes a pair of spaced apart side plates.

3. The mounting assembly as set forth in claim 2, wherein said side plates of each clamp are parallel to one another.

4. The mounting assembly as set forth in claim 2, wherein said side plates are identical.

5. The mounting assembly as set forth in claim 2, wherein said side plates include connecting extensions for attachment of said interconnection members.

6. The mounting assembly as set forth in claim 5, further comprising reinforcing plates attached to said connecting extensions, said reinforcing plates having apertures for receiving said interconnection members.

7. The mounting assembly as set forth in claim 2, further comprising a middle support plate attached to and interconnecting each of said pair of side plates, said middle support plate configured for receipt and attachment of the antenna platform or mounting arm to be supported.

8. The mounting assembly as set forth in claim 7, further comprising a flange attached to and extending between each pair of side plates and also attached to said middle support plate for providing structural stability to said clamps.

9. The mounting assembly as set forth in claim 1, further comprising a shim plate adjustably connected to one of said clamps.

10. The mounting assembly as set forth in claim 1, wherein said interconnection members include rods having threaded ends and nuts threadable onto the threaded ends for adjustably tightening said clamps about the pole.

11. The mounting assembly as set forth in claim 1, wherein the same sized clamps may are configured for use on a variety of pole diameters, and the length of said interconnection members is increased as the pole diameter is increased.

12. A mounting assembly for affixing an antenna platform or mounting arm to a pole, said mounting assembly comprising a plurality of clamps for clamping about the circumference of the pole; a plurality of interconnection members interconnecting said clamps about said pole, said interconnection members being adjustable for tightening said clamps on said pole; and a shim plate adjustably mounted to one of said clamps for closing any gaps between the pole and said clamps.

13. The mounting assembly as set forth in claim 12, wherein each of said clamps includes a pair of spaced apart side plates.

14. The mounting assembly as set forth in claim 13, wherein said pair of side plates on each clamp are parallel to one another.

15. The mounting assembly as set forth in claim 13, wherein said side plates are identical.

16. The mounting assembly as set forth in claim 13, wherein said side plates include connecting extensions for attachment of said interconnection members.

17. The mounting assembly as set forth in claim 16, further comprising reinforcing plates attached to said connecting extensions, said reinforcing plates having apertures for receiving said interconnection members.

18. The mounting assembly as set forth in claim 13, further comprising a middle support plate attached to and interconnecting each of said pairs of side plates, said middle support plates configured for receipt and attachment of the antenna platform or mounting arm to be supported.

19. The mounting assembly as set forth in claim 18, further comprising a flange attached to and extending between each of said pairs of side plates and also attached to said middle support plate for providing structural stability to said clamps.

20. The mounting assembly as set forth in claim 12, wherein there are three clamps and each clamp has a pole mounting surface contoured to fit against the circumference of a variety of poles having different diameters.

21. The mounting assembly as set forth in claim 12, wherein said interconnection members include rods having threaded ends and nuts threadable onto said threaded ends for adjustably tightening said clamps about the pole.

22. The mounting assembly as set forth in claim 12, wherein the same sized clamps may be used on a variety of pole diameters, and the length of said interconnection members is increased as the pole diameter is increased.

* * * * *

UNITED STATES PATENT AND TRADEMARK OFFICE

CERTIFICATE OF CORRECTION

PATENT NO. : 6,563,475 B2
DATED : May 13, 2003
INVENTOR(S) : Daniel J. Ianello and Thomas N. Strantz It is certified that error appears in the above-identified patent and that said Letters Patent is hereby corrected as shown below:

Column 6,
Line 13, delete the word "may"

Signed and Sealed this

Second Day of September, 2003

JAMES E. ROGAN
*Director of the United States Patent and Trademark Office*